US008075635B2

(12) United States Patent
Orlandi et al.

(10) Patent No.: US 8,075,635 B2
(45) Date of Patent: Dec. 13, 2011

(54) DYE SCAVENGING AND WATER SOFTENING PRODUCT

(75) Inventors: Vittorio Orlandi, Arsago Seprio (IT); Andrea Agostini, Milan (IT); Franscesco Maurizio Orlandini, Codogno (IT); Paola Curi, Brunate (IT); Raffaella Meregalli, Desio (IT)

(73) Assignees: Orlandi S.p.A., Milan (IT); Bolton Manitoba S.p.A., Milan (IT)

( * ) Notice: Subject to any disclaimer, the term of this patent is extended or adjusted under 35 U.S.C. 154(b) by 552 days.

(21) Appl. No.: 12/161,531

(22) PCT Filed: Sep. 20, 2006

(86) PCT No.: PCT/IT2006/000667

§ 371 (c)(1),
(2), (4) Date: Oct. 21, 2008

(87) PCT Pub. No.: WO2007/083335

PCT Pub. Date: Jul. 26, 2007

(65) Prior Publication Data

US 2009/0151083 A1 Jun. 18, 2009

(30) Foreign Application Priority Data

Jan. 20, 2006 (IT) ..... MI2006A0096

(51) Int. Cl.
*D06M 15/70* (2006.01)

(52) U.S. Cl. ..... 8/115.6; 510/276; 510/295; 510/298

(58) Field of Classification Search ..... 8/115.6; 510/276, 295, 298

See application file for complete search history.

(56) References Cited

U.S. PATENT DOCUMENTS

| | | | | |
|---|---|---|---|---|
| 3,694,364 | A | 9/1972 | Edwards | |
| 2006/0058212 | A1 * | 3/2006 | McNamee | 510/499 |

FOREIGN PATENT DOCUMENTS

| | | |
|---|---|---|
| WO | WO 96/26831 | 9/1996 |
| WO | WO 96/26831 | * 10/1996 |
| WO | WO 99/15614 | 4/1999 |
| WO | WO 03/010275 | 2/2003 |
| WO | WO 03/072695 | 9/2003 |
| WO | WO 03/072695 | * 10/2003 |
| WO | WO 2004/067691 | 8/2004 |

* cited by examiner

*Primary Examiner* — Amina Khan
(74) *Attorney, Agent, or Firm* — Dickstein Shapiro LLP

(57) ABSTRACT

The present invention relates to a material for removing dye released from laundry into the wash water, and for removing limescale, comprising a substrate made of natural and/or synthetic fabric, natural and/or synthetic non-woven fabric and paper, at least one 'dye scavenging' additive selected from: cationic heterocyclic polymers, proteins, chitin, chitosan, polyvinylamine (PVA), polyethylenimine (PEI), acrylic polymers, vinyl polymers, polyamine-N-oxide and at least one calcium and magnesium ion sequestrant additive selected from: polyacrylate, polyphosphonate and an EDTA salt. The invention also relates to a process for obtaining said material.

14 Claims, 1 Drawing Sheet

TABLE 1

| EMPA 221 40 °C (with EMPA 130) REFERENCE: EMPA 221 TQ. POLYESTHER LOADING | | | | | | | | | | | | | | | | | | |
|---|---|---|---|---|---|---|---|---|---|---|---|---|---|---|---|---|---|---|
| id | L | s(L) | s2(L) | a | s(a) | s2(a) | b | s(b) | s2(b) | ΔL | Δa | Δb | ΔL2 | Δa2 | Δb2 | ΔE | s(ΔE) | EVALUATION ΔE |
| REFERENCE: EMPA 221 | 96,18 | 0,01 | 0,00 | -0,27 | 0,01 | 0,00 | 2,27 | 0,02 | 0,00 | | | | | | | | | |
| SALVATUTTO 85 g | 93,94 | 0,40 | 0,16 | 1,22 | 0,38 | 0,14 | 1,47 | 0,26 | 0,07 | -2,24 | 1,49 | -0,80 | 5,02 | 2,22 | 0,64 | 2,81 | 0,09 | LIGHT |
| GREY ACCHIAPPACOLORE | 93,63 | 0,40 | 0,16 | 1,99 | 0,56 | 0,31 | 1,13 | 0,32 | 0,10 | -2,55 | 2,26 | -1,14 | 6,50 | 5,11 | 1,30 | 3,59 | 0,11 | STRONG |

TABLE 2

| EMPA 410 ON VISCOSE 40 °C (with EMPA 130) REFERENCE: EMPA 410 TQ. 1POLYESTHER LOADING | | | | | | | | | | | | | | | | | | |
|---|---|---|---|---|---|---|---|---|---|---|---|---|---|---|---|---|---|---|
| id | L | s(L) | s2(L) | a | s(a) | s2(a) | b | s(b) | s2(b) | ΔL | Δa | Δb | ΔL2 | Δa2 | Δb2 | ΔE | s(ΔE) | EVALUATION ΔE |
| REFERENCE | 95,54 | 0,07 | 0,0049 | -0,45 | 0,03 | 0,00 | 2,63 | 0,09 | 0,01 | | | | | | | | | |
| SALVATUTTO 85 g | 93,21 | 0,32 | 0,10 | 1,05 | 0,46 | 0,21 | 2,29 | 0,18 | 0,03 | -2,33 | 1,50 | -0,34 | 5,43 | 2,25 | 0,12 | 2,79 | 0,09 | LIGHT |
| GREY ACCHIAPPACOLORE | 93,33 | 0,47 | 0,22 | 1,76 | 0,69 | 0,48 | 1,92 | 0,32 | 0,10 | -2,21 | 2,21 | -0,71 | 4,88 | 4,88 | 0,50 | 3,21 | 0,14 | STRONG |

Fig. 1

DYE SCAVENGING AND WATER SOFTENING PRODUCT

FIELD OF THE INVENTION

The present invention relates to a material for removing excess dye from wash water and for the softening of the same, and a method for the production thereof.

BACKGROUND OF THE INVENTION

It is well known that the majority of "coloured"garments loose a certain amount of dye in the wash water and must therefore be washed separately from "white" garments, in order to avoid them becoming partially or totally dyed.

This problem has afflicted housewives throughout the world for some time and has always been resolved by carefully separating "coloured" garments from "whites", or by using low temperature wash programs or by trying to make the pigments bind more tightly to the garment. In these cases, it is not always possible to obtain the desired results and very frequently, after machine washing, it is found that the "whites" are completely or partially dyed.

Another problem affecting housewives all over the world, and especially those living in areas where the mains water is hard, is the formation of limescale on the interior surfaces of the washing machine.

Water hardness is the quantity of alkaline earth metal salts, particularly calcium and magnesium bicarbonates and sulphates, present in solution in the water. Water is defined as being averagely hard if it has a lime content (calcium carbonate) of between 150 and 250 mg/l (15-25° F.), while it is considered hard if the lime content exceeds 250 mg/l (from 25° F.).

With passing time, medium hard or hard waters deposit a layer of limescale on the inner surfaces of washing machines which, if not periodically eliminated, can cause choking of drains, malfunctioning of washing machine components etc., with the consequent breakdown of the device and/or abundant water leakage.

In addition, the presence of high quantities of calcium and magnesium salts dissolved in the water, with passing time, cause damage to the washed garments and to the environment. Indeed, calcium and magnesium salts partially neutralise the action of detergents, resulting in overdosing of the detergent itself, increased cost and greater environmental pollution. The damage caused to washed garments is due to the microdeposition of lime in the fibres, resulting in loss of garment softness, thus provoking its premature deterioration.

Normally, in order to avoid the aforementioned problems, inside the wash tub itself, the detergent is supplemented with suitable quantities of softener, which is normally in powder, tablet or liquid form.

SUMMARY OF THE INVENTION

This invention tackles the two aforementioned wash problems from a different viewpoint, i.e. providing a material which not only allows the complete elimination of any dye present in the wash water, thus avoiding the dyeing of "whites", but at the same time has a water softening action.

Consequently, "coloured" and "white" garments may be washed at the same time in the washing machine in the presence of the material of the invention which acts as a "dye scavenger". At the same time, the material of the invention exerts a softening action on hard waters, thus replacing or supplementing conventional softeners.

Thus, the present invention relates to a material comprising a substrate, a suitable additive which removes dye and a suitable additive which softens water, as described in the appended claims.

BRIEF DESCRIPTION OF THE FIGURES

Further characteristics and advantages of the present invention will become more apparent from the following detailed description, with reference to FIG. 1, showing two tables reporting experimental data comparing the product of the invention and a commercial product.

DETAILED DESCRIPTION OF THE INVENTION

The substrate may be comprised of any material, compatible with normal washing, and have any form and size such as, for example, a handkerchief or a piece of cloth. Preferably, the substrate is shaped like a handkerchief.

Typically, the substrate is a natural and/or synthetic fabric, a natural and/or synthetic non-woven fabric or paper. Preferably, the substrate is a natural and/or synthetic non-woven fabric, more preferably, it is a synthetic non-woven fabric.

Non-woven fabrics which can be conveniently used include: spunlaced, spunbonded, thermobonded, airlaided.

The terms spunlaced, spunbonded, thermobonded, airlaided indicate both the non-woven fabrics and the techniques used for the attainment thereof, well known in the art. The fibres preferably used to obtain such non-woven fabrics include the following: polyester (PE), polypropylene (PP), polylactic acids (PLA), polyethylenesulphone (PES), acrylic polymers, regenerated cellulose, for example lyocell® (i.e. regenerated cellulose fibre, obtained using a process of dissolution and spinning in organic solvent) or tencell® cotton, viscose or mixtures thereof. Preferably, the substrate is 100% regenerated cellulose, for example: lyocell® or tencell®. More preferably, the substrate is 100% regenerated cellulose obtained using the spunlaced technique.

The substrate plays the role of "carrier" for the dye-removing additive and the water-softening additive.

The dye-removing additive may be any substance with a very high affinity for dyes. Indeed, one of the principles underlying the invention is that the dye released into the wash water from the "coloured" garments has greater affinity for the material of the present invention than for the "white" garments.

Preferably, the aforementioned additive is selected from: cationic heterocyclic polymers, proteins, chitin, chitosan, polyvinylamine (PVA), polyethylenimine (PEI), acrylic polymers, vinyl polymers, polyamine-N-oxide and mixtures thereof. More preferably, the additive is selected from: cationic heterocyclic polymers, acrylic polymers, vinyl polymers and mixtures thereof. Even more preferably, the additive is a cationic heterocyclic polymer, for example COBRAL MM, COBRAL DD/50 or COBRAL CK sold by Lamberti S.p.A. Said cationic heterocyclic polymers all belonging to the class of cationic heterocyclic polymers synthesised from epichlorhydrin and imidazole.

Particularly, the cationic heterocyclic polymer COBRAL DD/50 is identified by the CAS number 68797-57-9 and has a molecular weight of 160,603 Da.

The dye-removing additive may be advantageously prepared in solution with a base, preferably a strong base such as NaOH, and water. This solution is particularly adapted to the application of the additive using techniques used in the dye sector.

The substrate preferably has a weight comprised of between 150 g/m$^2$ and 50 g/m$^2$, more preferably between 100 g/m$^2$ and 60 g/m$^2$. The dimensions of the substrate fibres are preferably between 0.5 dtex and 5 dtex, preferably between 1 dtex and 2 dtex.

The water softener or calcium and magnesium ion sequestrant is a compound comprising a product selected from polyacrylate, polyphosphonate and a salt of EDTA (ethylenediaminetetracetic acid). For example, the sequestrant is used in such a quantity, developed to leave a mass comprised of between 5 and 100 g/m$^2$ (with reference to dry substrate) on the substrate, preferably between 7 and 50 g/m$^2$, more preferably approx. 10 g/m$^2$. The sequestrant product may also be the product sold under the trade name TEXTOL CK from Lamberti S.p.A.

In order to make the sequestrant applicable to the non-woven fabric substrate, for example by means of a serigraphic process, the compound also comprises a polyurethane, acrylic or natural thickener. The thickener may furthermore be used in quantities comprised of between 5% and 100% with respect to the quantity of sequestrant, preferably between 20% and 80%, more preferably approx. 50%. Obviously, the quantity and specific type of thickener may be selected by one skilled in the art depending on the type of application, the settings on the machine and the selected substrate. The preferred natural thickener is Guar flour IDALCA from Lamberti S.p.A. or, alternatively, LAMBICOL 190 or LAMBICOL 491/N also from Lamberti.

As already mentioned, in the case where the sequestrant is used in combination with the thickener, a viscous mixture is obtained which can preferably be stabilised with a dispersant, for example acrylic based. The quantity used of such substance may be comprised of between 5% and 50% with respect to the quantity of sequestrant, preferably between 7% and 20%, more preferably approx. 10%.

Furthermore, advantageously, the mixture may be comprised of a substance known as a "false dye" (technically, a blocked standard dye), i.e. a substance which dyes the substrate but which cannot attach itself stably to any fabric. In use, the "false dye" dissolves in the wash water without interfering with either the laundry or the product of the invention. Particularly, the softening compound of the invention is essentially colourless. The use of a "false dye" allows colouring the softener when this is applied (printed) onto the substrate (white) for example in order to highlight the manufacturers logo or some other trademark. When the substrate is immersed in the wash water, the softener has a tendency to dissolve slowly during the wash cycle and, at the same time, the surface of the surrounding substrate becomes coloured almost immediately, due to the effect of the dye scavenger. As it has emerged, the non-woven fabric substrate becomes coloured due to the effect of capturing the dye released by the garments into the wash water, except where the water softener has been applied, where the logo will remain negatively stained. In other words, the colour released from dyed garments is immediately captured by the white substrate, which then becomes coloured thanks to the dye scavenger substance, while the water softener, which is coloured and only applied to certain parts of the substrate, slowly dissolves to reveal the white substrate.

Additionally, advantageously, the softener may include a binding agent. The binder is any substance capable of holding the non-woven fabric substrate together. In other words, the binder allows strengthening the substrate in order to avoid the washing machine wash cycles to ruin the non-woven fabric structure. Particularly, modern washing machines have wash cycles, but above all spin cycles, that are very powerful. This causes rapid deterioration of fabrics in general, and a spunlaced substrate in particular, a product which is versatile due to its softness, feel and colour binding capacity. Indeed, the spunlaced substrate might unravel releasing fibres into the wash water which might then attach themselves to the garments being washed, with imaginable consequences.

The binder may be a resin, such as for example an acrylic, vinyl, polyurethane or natural resin. The binding agent might also be a natural or synthetic latex. The quantity of binder used may vary between 5% and 100% of the sequestrant, preferably between 7 and 50%, more preferably approx. 10%.

A second subject of the invention is a process for the preparation of a water softener for treating a non-woven fabric substrate.

The process consists of a stage involving the preparation of a very dense mixture (consequently similar to honey) of said compounds, by dispersing the sequestrant in water and adding the thickener while stirring.

Advantageously, the process may comprise a stage wherein the 1 to 100 g/l of false dye are added to the thickened mixture thus obtained.

Optionally, said process may comprise a binder adding step.

Preferably, the process comprises a stage where dispersant is added to the mixture to stabilise it.

Once the basic sequestrant compound is prepared in a suitable solvent or in a composition with the other above-mentioned ingredients, said compound is applied onto the non-woven fabric substrate using application methods known in the sector such as, for example, impregnation, spreading or printing, as will be described in detail below.

The product forming the subject of the present invention may be obtained by combining, in any way, one of the substrates listed above with one or of the additives. The preferred finished product comprises spunlaced 100% regenerated cellulose non-woven fabric, to which are fixed at least one cationic heterocyclic polymer, which has the role of scavenging dye, and at least one polyacrylic, polyphosphonate or EDTA salt sequestrant, which has the role of softening the water.

In another aspect, the present invention relates to a process for the manufacture of the product of the invention.

Said process consists of the following steps:

a) providing a substrate comprising one of the following materials: natural and/or synthetic fabric, natural and/or synthetic non-woven fabric and paper;
b) treating the substrate with at least one dye scavenging additive selected from those described above;
c) removing any excess dye scavenging additive;
d) drying the substrate;
e) applying onto the semi-finished substrate obtained from step d) a compound comprising at least one calcium and magnesium ion sequestrant selected from polyacrylate, polyphosphonate, an EDTA salt;
f) drying the substrate, so as to obtain the finished product.

Steps b) to f) are preferably achieved using impregnation, spraying, printing and/or plating, all techniques well known in the art. Preferably, the dye scavenging additive is applied by impregnation.

Even more advantageously, it is possible to use conventional dyeing techniques.

The relationship established between the additive and the substrate may be: absorption, adsorption, hydrogen bonding, electrostatic forces, for example ion/ion or ion/dipole interactions, incorporation, chemical or physical bonding etc.

In the case where dyeing techniques are used, then methods such as for example, beam dyeing machine, Jigger, Flow, Jet, Pad-batch dyeing, exhaustion bath impregnation may be used.

In particular, in the dyeing technique, step b) comprises the application of a suitable concentration of dye scavenging additive solution onto the substrate.

Furthermore, according to the Pad-batch or the "exhaustion bath" method, the impregnating solution is an aqueous solution comprising the dye scavenging compound and caustic soda.

Otherwise, the preferred "beam dyeing machine" method envisages a step b) comprising a first rinse of the substrate, contact with an aqueous solution of the dye scavenging compound, heating up to a temperature of between 40° and 70° C. Preferably, said heating takes place gradually, at 1° C. per minute until reaching the preferred temperature of 50° . The solution and substrate are left in contact for 15 minutes, then NaOH added slowly (over approx. 10 minutes). The solution is kept at said temperature for a period of time comprised of between 1 minute and 60 minutes, preferably between 1 and 20 minutes, more preferably approx. 10 minutes.

As already mentioned, the additive solution is preferably an aqueous solution alkalinised by the addition of a base, preferably NaOH, in order to promote fixing of the dye scavenging product. The concentration of the base is comprised if between 0.5 and 100% of the fabric, preferably between 0.5 and 4%, more preferably 2% of 36Be NaOH. The concentration of the additive is generally equal to that of the caustic soda.

The treatment solution is then removed and the product rinsed with water (hot or cold). The last rinse envisages the addition of acetic acid in order to neutralise the finished product.

In the case where step c) is performed using the Pad-Batch technique, the support is transferred into a tank with the solution, where is it impregnated, then excess dye catcher additive is eliminated, for example by passing the substrate through two or more rollers and pressing it (foulard technique). The squeezing pressure depends on the quantity of additive it is desired to leave in the finished material and the concentration of the solution or the additive as applied in step a). Furthermore, following squeezing, the wet substrate is left to rest for a period of time of between 30' and 24 hours, preferably between 3 and 4 hours, optionally wound-up and turning. Finally, step c) comprises a wash stage, essentially in common with all methods except the "exhaustion bath" method. The equipment used to execute the aforementioned technologies may also be used to wash the product, besides dyeing it, while the equipment used for the Pad-batch technique requires an additional machine for the foulard step. Particularly, this is standard equipment from the dyeing sector, and is in accordance with the appropriate wash programs, and a final stage for neutralising the NaOH with an appropriate substance.

Step b) may also be performed at room temperature.

In step d), the substrate is dried, preferably in a kiln, at a temperature comprised of between 70° C. and 200° C., preferably between 100° C. and 170° C., more preferably around 120° C. for a quantity of time that depends on the quantities of additive and solvent present, the temperature and efficiency of the drying system.

For example, in order to obtain a material containing a quantity of additive of approx. 2% by weight, with respect to the weight of the substrate, it is possible to operate in different manners depending on the type of method used. For example, if the "beam dyeing machine" method is used, then to the non-woven fabric substrate, after having been charged in the equipment charged with water, is introduced the dye scavenging additive in quantities directly proportional to the weight of said fabric. In other words, if the weight of the substrate is 100 g/m$^2$ and it is desired to have a quantity of additive of 2% by weight, then the quantity of additive to be added is 2 grams.

On the other hand, if the pad-batch method is used, again wishing to obtain a quantity of additive on the substrate of 2% by weight with respect to the weight of the substrate, then for a substrate of 100 g/m$^2$ a solution may be prepared containing 4% by weight of additive, and such squeezing performed as to obtain an absorption of 50% of the solution onto the substrate. Alternatively, for the same weight of substrate, it is possible to prepare a 1% solution and perform such squeezing as to allow an absorption of 200% of said solution.

Preferably, a oven is used where the non-woven fabric substrate is suspended inside the heated chamber so that is doesn't come into contact with any parts of the oven itself. Particularly, entirely standard RAM type equipment may be used, which advantageously allows optimal control of the temperature, essentially without any contact with the oven, the possibility of monitoring the stability in relation to depth, elongation (stretching) and grammage. This all helps with the stability and resistance of the substrate inside the washing machine.

The parameters described above may easily be adjusted by one skilled in the art, depending on the material it is desired to obtain (i.e. more or less impregnated with additive) and the machinery available. For example, if a very efficient oven is available, then drying time may be reduced significantly thus speeding up the entire process; if the foulard technique is used, where squeezing takes place using three drums, the pressure applied may be less than that used in the case of squeezing through 2 drums etc.

Step e) may be performed using any method known in the art, such as for example impregnation, spreading and printing. The preferred method is printing and, particularly, serigraphic printing.

For serigraphic printing, a dense mixture comprising of the sequestrant, the thickener and optionally, the false dye, is prepared as described above.

In step e) the dense mixture, prepared for example as described above, may be applied by printing onto the substrate following the drying step d), preferably by serigraphic printing.

The quantity of dense mixture which is applied to the substrate is comprised of between 1 and 100 g/m$^2$ with reference to the substrate, preferably between 5 and 50 g/m$^2$, even more preferably between 20 g/m$^2$.

The quantity of dense mixture and, therefore, the sequestrant additive which can be applied to the substrate, must be correctly balanced between too low an amount, which would have poor activity, and an overly high quantity which, would be very active, but would partially interfere with the activity of the dye scavenging additive. Different quantities may be envisaged depending on the level of hardness of the water, with which it is expected the product of the invention will be used.

In step f) the substrate is dried at a temperature of no greater than 120° C., preferably around 100° C.

Steps a)-d) are preferably carried out continuously (beam dyeing machine method), i.e. the subject is subjected to impregnation, squeezing and drying without any intermediate steps or interruptions (optionally to allow the additive to bind better to the substrate) between one treatment and the next. This is all possible since the additive has high affinity for the substrate and, therefore, the desired quantity of additive binds almost immediately to the substrate, and it is not necessary to leave the substrate impregnating for any length of time.

After the drying step d), the semi-finished product may be rolled up and transferred into another machine, where it will be unrolled and subjected to steps e) and f). Alternatively, the semi-finished product from step d) is not rolled up, but is immediately sent for printing (step e)) and, afterwards, drying (step f)) and then rolled up. In other words, the production process may be carried out continuously, using a single machine, from step a) to step f), or in "batch mode" by performing steps a)-d) using one machine, and then steps e)-f) using a different machine.

The product of the invention is normally inserted into conventional or professional washing machines along with the "whites" and "coloured" garments, prior to starting the wash cycle.

By the term "white" garments is meant washing consisting of white and lightly coloured fabrics (for example: beige, pink, sky blue, grey etc.); preferably light coloured fabrics.

By the term "coloured" garments is meant washing consisting of dark coloured fabrics (for example: red, burgundy, yellow etc.) or very dark fabrics (for example: blue, black, dark green, jeans etc.). Said fabrics may be new, or may have already been subjected to machine washing. Preferably, by the term "coloured" garments is meant washing consisting of dark coloured fabrics (for example: red, burgundy, yellow, orange etc.); more preferably dark coloured fabrics already subjected to 5 or 6 washes.

When the wash is started, the thickener dissolves in the water, releasing the sequestrant and the false dye. Thus, the sequestrant dissolved in the water will perform its role of capturing the calcium and magnesium ions, thus avoiding their deposition on the inner walls of the washing machine, in the form of carbonates and sulphates. The false dye is dispersed in the wash water, however, without dyeing the garments, and will be eliminated with subsequent rinses, along with the sequestrant bound to the calcium and magnesium ions. The false dye has the sole purpose of making the printed compound visible, becoming a commercial carrier and, at the same time, acting as an operational check. At the same time, the dye scavenging additive remains fixed to the substrate and performs its function by having higher affinity for the pigments present in the wash water with respect to the affinity of the pigments for the fabric of the "white" garments.

Ideally, the material of the invention is inserted inside the washing machine along with the light coloured fabrics and the dark coloured fabrics, having already been machine washed 5 or 6 times. The number of sheets of the material of the invention which are used for each wash depends on the weight of the washing, the colours present, and the hardness of the water. Preferably, 2 or more sheets of the material of the invention are inserted in the washing machine where there are fabrics which loose high quantities of dye, for example cotton fabrics with intense colours in the presence of hard water.

The material of the invention can withstand normal wash temperatures and standard detergents and additives, as well as bleach.

ADVANTAGES

The material of the invention is much more resistant, above all when wet, than the cotton which is normally used as a substrate for dye scavenging products, as will also be demonstrated in the tests performed and reported hereinafter. The combined action of the substrate and the dye, which both have high affinity for dyes, allows greater efficiency in holding the dye present in the wash water with respect to the products known in the art. Particularly, as is evident from the results reported below, it seems that the particular combination of the "dye scavenger" and the softener allows the attainment of a surprising synergistic effect whereby the efficacy of the product, above all in relation to the dye scavenging function, is enhanced in comparison to standard fabrics.

The dual "dye scavenging" and "limescale scavenging" function possessed by the product of the invention is very convenient. Indeed, with a single action it is possible to obtain the dual effect of protecting "white" garments from any loss of dye from darker fabrics, and with constant use, preserving the good operation of the washing machine.

This translates into higher practicality of use, above all for those people with little time to dedicate to housework who, this way, can wash "white" and "coloured" garments together, and at the same time no longer need to worry above all about remembering to add limescale treatment. Indeed, it has been shown experimentally that the product of the invention, if used regularly, has the same anti-limescale efficacy as conventional additives.

The process of the invention is very rapid, in that it may be performed continuously, and has a limited number of steps. This results in significant savings in time and energy. Indeed, the finished material is obtained in times in the order of a few minutes in that the "dye scavenging" additive binds to the substrate almost instantaneously, and it is not necessary to leave it to rest for hours (in order to ensure that the additive is absorbed onto the substrate) as with the processes of the known art. This is all possible thanks to the use of the "dye scavenging" additives of the present invention, which possess very high affinity for the substrate, and are absorbed in effective quantities practically immediately. Furthermore, the subsequent printing and drying steps are also themselves very rapid.

The particular preferred combination between a 100% regenerated cellulose substrate, for example lyocell®, a cationic heterocyclic polymer, for example COBRAL MM, and a polyacrylate-polyphosphonate sequestrant, for example CHELAM, is exactly that which has allowed the attainment of improved results in terms of resistance to the conditions of use, and efficiency.

COMPARATIVE EXAMPLES

Three comparative examples have been prepared, wherein in the first, on the one hand, the commercial product "Grey l'Acchiappacolore" L 28505 and on the other, the product of the invention known as "Salvatutto" have been compared. Particularly, the comparison has been carried out by assessing the "dye scavenging" activity on standard EMPA 130 fabric (red directly on cotton).

In the second example, the anti-limescale activity has been assessed in comparison to Calfort L M6 065 3 15 23:53 Reckitt Benckiser.

In the third example, the mechanical resistance of the product in accordance with the present invention (Salvattutto 85 g) has been assessed, even when faced with very "aggressive" spin drying, up to 1600 rpm, in order to assess the possibility that parts of the sheet can end up inside the mechanism of the washing machine, thus damaging it or choking it.

The washing machines used for the first two tests are the Ariston model AVL 88, the water hardness used for the tests on the coloured fabrics is equal to 25° F. On the other hand, in order to assess the resistance of the sheets to mechanical stress, the third test, Miele Novotronic W377 washing machines have been used.

COMPARATIVE EXAMPLE 1

"Dye Scavenging" Activity By Comparison With the Commercial Product Grey L'Acchiappacolore L 28505 Standard EMPA 130 Fabric (Red Directly On Cotton)

The "dye scavenging" activity on standard EMPA 130 fabric (red directly on cotton) has been assessed at 40° C.

The simulated load consisted of 21 polyester pillow cases (WFK 99199) onto one of which has been attached the 10×10 cm coloured fabric. This type of load has been selected in order to ensure that all the dye released by the fabric and not collected by the "dye scavenger" is collected by the monitor fabrics.

Onto another pillow case has been attached an EMPA 221 cotton fabric and an EMPA 410 multifibre fabric, both 10×10 cm, the function of which is to act as monitors of dye release. The total weight of the load was equal to 1 kg. 10 external wash repeats have been performed for each product. The detergent used is 100 ml of Omino Bianco Lavatrice Marsiglia 3 l—batch No. 6 02/05/06 11:11.

A machine test has been performed on the monitor fabrics, which, being based on the parameters "L", "a" and "b", assesses the difference in colour with respect to the clean fabric (ΔE).

The difference in colour with respect to the clean fabric (ΔE) is assessed in the following way:

ΔE<0.5: not detectable
0.5<ΔE<1.5: very light
1.5<ΔE<3: light
3<ΔE<6: strong
ΔE<6: very strong

BRIEF DESCRIPTION OF THE DRAWINGS

As may be observed from tables 1 and 2 reported in FIG. 1, under the test conditions, the "dye catching" efficacy of the product "Salvatutto" has been shown to be superior to that of Grey l'Acchiappacolore.

COMPARATIVE EXAMPLE 2

Evaluation of Anti-Limescale Activity

The anti-limescale activity of Salvatutto 85 g has been compared to that of Calfort L M6 065 3 l5 23:53. The detergent used is 100 ml of Omino Bianco Lavatrice Marsiglia 3 l—batch No. 6 02/05/06 11:11.

The following test fabrics have been used:

WFK11A
HONEY COMB
EMPA 221

50 washes at 40° C. with water hardened artificially, using a solution of calcium chloride and magnesium sulphate, in order to achieve a hardness of 43° F., have been performed with each product.

The simulated load was new and consisted of white cotton fabrics (table cloths and towels) in such quantities as to achieve an overall weight of 4 kg. 3 external wash repeats have been performed with the comparative products, and one with detergent alone.

The following assessments have been performed at time 0 and upon completion of the 50 washes:

resistance weight;
determination of the EMPA 221 and honeycomb ash at 800° C.;
determination of the organic deposits on WFK11A;
determination of the softness to touch of honeycomb and the towels in the load by means of a panel test (5 judges).

3 external wash repeats have been performed with the comparative products, and one with detergent alone.

The conditions of the resistances have been performed at time 0 and upon completion of the 50 washes. The difference between those used for the 50 washes with Salvatutto 85 g and Calfort is evident, with them being indistinguishable as well as from a new resistance, while that washed with detergent alone has obvious limescale deposits.

By weighing the resistances at t 0 and following the 50 washes, and comparing the results, no significant differences have been observed for Calfort and Salvatutto 85 g, while the resistance washed with detergent alone showed an increase in weight equal to 1.32 g.

Determination of softness to touch of honeycomb and the towels in the load, performed using an ordering test with 5 judges, did not highlight any differences between the fabrics washed with Calfort and those washed with Salvatutto. Statistical evaluation of the results, performed using a Friedman test, has highlighted that there are no differences between the two products at the 0.05 significance level.

The sizes of the honeycomb fabrics, assessed prior and following 50 washes, have highlighted a mean reduction in size of 27.8%, analogous for the fabrics washed with both products.

COMPARATIVE EXAMPLE 3

Evaluation of Mechanical Resistance

Within the scope of the mechanical problems which small sheets might cause washing machines, it. is highlighted that the first test performed in order of time has been that of anti-limescale capacity, which envisaged 50 washes with 3 external repeats, to give a total of 150 washes with Salvatutto. Over the course of this test, at the end of the washes, all the sheets have been recovered in the drums of the washing machines, and no mechanical problems of any kind occurred to the same.

The second test performed has been that on the standard dyed fabrics with a load of polyester, which envisaged 5 external repeats with Grey and 5 with Salvatutto: in 2 of the 5 washing machines which used Grey, the break up of the sheets was observed, with consequent choking of the washing machine, which had to be emptied manually. The sheets have been found lodged in the filter.

Overall Assessment of Performance

From analysis of the results obtained in the various tests, it has been observed that SALVATUTTO 85 g has anti-limescale activity that is comparable with a product that is specific for this function such as Calfort, greater "dye scavenging" action in comparison to Grey l'Acchiappacolore, and very high mechanical resistance which allows avoiding any blockages and damage to the washing machines due to the sheets breaking up.

It has furthermore been observed that, over the course of the 175 test washes performed with the sheets of unattached Salvatutto, the latter has always been recovered from the drum of the washing machine at the end of the wash, and have never resulted in choking of the washing machine, which on the other hand occurred twice with Grey Acchiappacolore.

The invention claimed is:

1. A production process for a "dye scavenging" and "limescale scavenging" material comprising the following steps:

a) providing a substrate selected from the group consisting of: natural and/or synthetic fabric, natural and/or synthetic non-woven fabric and paper;

b) treating the substrate with an additive comprising a cationic heterocyclic polymer;

c) eliminating excess additive by passing the substrate between two or more rollers, and then allowing the substrate to rest for a period of time comprising between 30 minutes and 24 hours, optionally rolled up and rotating;

d) drying the substrate;

e) applying onto the semi-finished substrate obtained from step d) a dense mixture comprising at least one calcium and magnesium ion sequestrant selected from polyacrylate, polyphosphonate, an EDTA salt;

f) drying the substrate, so as to obtain the finished product.

2. The process according to claim 1 wherein, in step b) , the substrate is treated by impregnation, spraying, printing and/or plating.

3. The process according to claim 2 wherein, in step b) in the case where impregnation is used, the substrate is treated with a solution of dye scavenger additive.

4. The process according to claim 3 wherein said solution of additive is an aqueous solution, made alkaline through the addition of a base.

5. The process according to claim 4 wherein the quantity of base used is comprised of between 0.5% and 100%.

6. The process according to claim 1 wherein the concentration of additive is comprised of between 0.5% and 100%.

7. The process according to claim 1, wherein step b) comprises the following steps in sequence:

rinsing the substrate;

applying said aqueous solution to the dye scavenging compound and heating to a temperature comprising between 40° C. and 70° C.;

adding a base; keeping the substrate in contact with the dye scavenger and the base for a period of time comprised of between 1 minute and 60 minutes.

8. The process according to claim 1, wherein step c) comprises a final wash stage.

9. The process according to claim 1 wherein, in step d) , the substrate is dried in a kiln at a temperature comprised of between 70 and 200° C.

10. The process according to claim 1 wherein, in step d) , the substrate is dried for a period of time comprised of between 1 and 5 minutes.

11. The process according to claim 1 wherein, in step e), applying occurs by printing using the serigraphic technique.

12. The process according to claim 1 wherein the quantity of dense mixture which is applied to the substrate comprises between 1 and 100 $g/m^2$.

13. The process according to claim 1 wherein, in said step f), drying occurs at a temperature of less than 120° C.

14. The process according to claim 1 which is performed continuously.

* * * * *

UNITED STATES PATENT AND TRADEMARK OFFICE

CERTIFICATE OF CORRECTION

PATENT NO. : 8,075,635 B2
APPLICATION NO. : 12/161531
DATED : December 13, 2011
INVENTOR(S) : Vittorio Orlandi et al.

It is certified that error appears in the above-identified patent and that said Letters Patent is hereby corrected as shown below:

Title Page, Item (75) Inventors, third inventor Orlandini's first given name should read --Francesco--.

Signed and Sealed this
Twenty-eighth Day of February, 2012

David J. Kappos

David J. Kappos
*Director of the United States Patent and Trademark Office*